US005329667A

United States Patent [19]

Erskine

[11] Patent Number: 5,329,667

[45] Date of Patent: Jul. 19, 1994

[54] PINLESS HINGE

[75] Inventor: Edward J. Erskine, Northville, N.Y.

[73] Assignee: N.A. Taylor Co., Inc., Gloversville, N.Y.

[21] Appl. No.: 710,770

[22] Filed: May 3, 1991

[51] Int. Cl.[5] ..... E05D 1/04

[52] U.S. Cl. ..... 16/269; 16/355

[58] Field of Search ..... 16/355, 356, 362, 363, 16/364, 260, 269, 271

[56] References Cited

U.S. PATENT DOCUMENTS

| | | | |
|---|---|---|---|
| 3,242,523 | 3/1966 | Daley | 16/269 |
| 3,484,895 | 12/1969 | Mock | 16/356 |
| 3,633,244 | 1/1972 | Grossman | 16/355 |
| 3,648,328 | 3/1972 | McCabe | 16/355 |
| 3,718,943 | 3/1973 | Bustin | 16/355 |
| 4,852,213 | 8/1989 | Shewchuk | 16/355 |

FOREIGN PATENT DOCUMENTS

| | | | |
|---|---|---|---|
| 6506353 | 11/1966 | Netherlands | 16/355 |
| 0562949 | 6/1975 | Switzerland | 16/269 |
| 1278496 | 6/1972 | United Kingdom | 16/355 |
| 2076884 | 12/1981 | United Kingdom | 16/355 |

OTHER PUBLICATIONS

Page from a ROTON catalog, admitted prior art.

Photocopy of prior public use structure for a pick-up truck.

*Primary Examiner*—Lowell A. Larson

*Attorney, Agent, or Firm*—Nixon & Vanderhye

[57] ABSTRACT

A pinless hinge is provided for pivotally connecting panel assemblies (such as boat windshield components), comprising first and second elongated cooperating aluminum extrusion components. The first component has a first flange with a hooked termination of a first distal end, and including an interior arcuate surface having a radius of about 180°, and an exterior projecting surface opposite the interior arcuate surface. A second component includes a second body having a second flange extending outwardly and terminating in a second distal end, including a second arcuate surface having a second radius equal to or slightly less than the first radius and an interior opening of approximately the same size and shape as the hooked termination of the first distal end. A third flange extends outwardly from the second body and has a side wall spaced from the second flange throughout the majority of its length a distance approximately equal to the maximum dimension of the first flange exterior projecting surface from the first flange interior arcuate surface. A third flange side wall has an arcuate portion with a radius and the exterior projecting surface of the first flange includes at least a portion thereof having a radius approximately equal to the radius of the third flange arcuate portion. The two component hinge allows relative rotation of more than 140° between its components without detachment by providing multiple axes of rotation along an arcuate path.

16 Claims, 5 Drawing Sheets

PINLESS HINGE

BACKGROUND AND SUMMARY OF THE INVENTION

In the construction of boat windshields, and other structural elements associated with panels, it is common to connect the elements together using aluminum extrusions having semicircular staggered elements which cooperate with similar elements on another panel to receive a pin, the pin then providing—with the semicircular elements—a hinge. While such hinges effectively perform their intended function, there are significant difficulties in assembly, and long assembly times, associated therewith. In order to eliminate such problems there have been commercial prior art systems developed, such as the "Roton" system, that utilize pinless hinges by providing cooperating gear elements attached to the panels; however, such prior art commercial pinless systems are typically complicated. Prior art two component hinges are not capable of more than 140° relative movement with respect to each other.

According to the present invention, a pinless hinge system—particularly adapted for use in pivotally connecting boat windshield panels together, but utilizable for a wide variety of other functions—is provided which is simple while at the same time being effective. The hinge of the invention has only two components, yet is capable of more than 140° relative movement with respect to each other, typically 180° or more (up to about 270°), without disconnecting.

The hinge according to the present invention is preferably formed from only two aluminum extrusions. The extrusion components are designed in such a way that they readily interfit with each other, sliding into place in an effective manner, and will allow significant pivotal movement between the connected components. The range of movement is at least about 90°, and less than about 270°, and typically is generally about 180°-190°. In their range of movement, the components allow free pivotal action, yet will not inadvertently come apart and provide positive stops at the ends of the range of movement. Also, though they will not detach in their normal range of movement, they can be readily slid longitudinally with respect to each other to be detached from each other. The range of movement of more than 140° is accomplished by providing different axes of rotation at different relative positions of the components.

According to one aspect of the present invention, there is provided a hinge comprising first and second elongated cooperating components. The first component comprises a first body, a generally straight first flange extending outwardly therefrom and terminating in a first distal end; and a hooked termination of the first distal end, including an interior arcuate surface having a first arc extending at least about 90 degrees and less than about 270 degrees, and an exterior projecting surface opposite the interior arcuate surface, the interior and exterior surfaces terminating in a common distal termination. The second component comprises a second body, having: a second flange extending outwardly therefrom and terminating in a second distal end, including an exterior arcuate surface having a second arc extending at least about 90 degrees and less than about 270 degrees, and equal to or slightly less than the first arc and an interior opening of approximately the same size and shape as the common distal termination of the first distal end; and a third flange extending outwardly from the second body and having a side wall spaced from the second flange throughout the majority of the length thereof a distance approximately equal to the maximum dimension of the first flange exterior projecting surface from the first flange interior arcuate surface.

The elongated first and second bodies typically comprise channel-shaped elements having a base and a pair of side walls extending upwardly from the base, and the flanges extending outwardly from the bases. A panel is typically received within each of the channel-shaped body elements. The panels typically are primarily of transparent material when used as boat windshield components. Other shapes to the bodies may be provided besides channels, such as plates, U's, clamps, or the like to allow permanent or temporary fixation to panels.

Also, typically, a flat distal surface on the third flange side wall forms a stop for relative movement of the first flange with respect to the second flange, and the third flange is hollow. The third flange side wall also preferably has an arcuate portion with an arc, and the exterior projecting surface of the first flange includes at least a portion having an arc approximately equal to the arc of the third flange arcuate portion. A flat distal surface of the third flange side wall, adjacent the arcuate portion, forms the stop for relative movement between the flanges in one direction, while a generally straight portion of the second flange cooperates with the first straight flange portion to provide a stop in the other direction of movement.

The invention also relates to pivotally connected first and second panel assemblies utilizing the hinge components as described above and connected to panels, and the invention also comprises aluminum extrusions which form the individual first and second components.

The invention further contemplates a two piece hinge consisting of first and second elongated components. There also are provided surface means extending from the components for cooperating with each other so that the components are movable in controlled operative engagement with each other from a first position to a second position, one of the components movement through an arc of greater than 140° from the first position to the second position. Preferably the arc is at least about 180°, and there are multiple axes of rotation, e.g. there are two stationary and one sliding axes of rotation, when the components move between their extreme positions.

It is a primary object of the present invention to provide for the effective and simple pivotal connection of panel components. This and other objects of the invention will become clear from an inspection of the detailed description of the invention, and from the appended claims.

BRIEF DESCRIPTION OF THE DRAWINGS

FIG. 3 is an end view of the first component of the structure of FIG. 2; while

FIG. 5 is an end view showing the cooperation between the first and second components of FIG. 2 at one limit of the pivotal range of motion therebetween; while

DETAILED DESCRIPTION OF THE DRAWINGS

Figure 1:
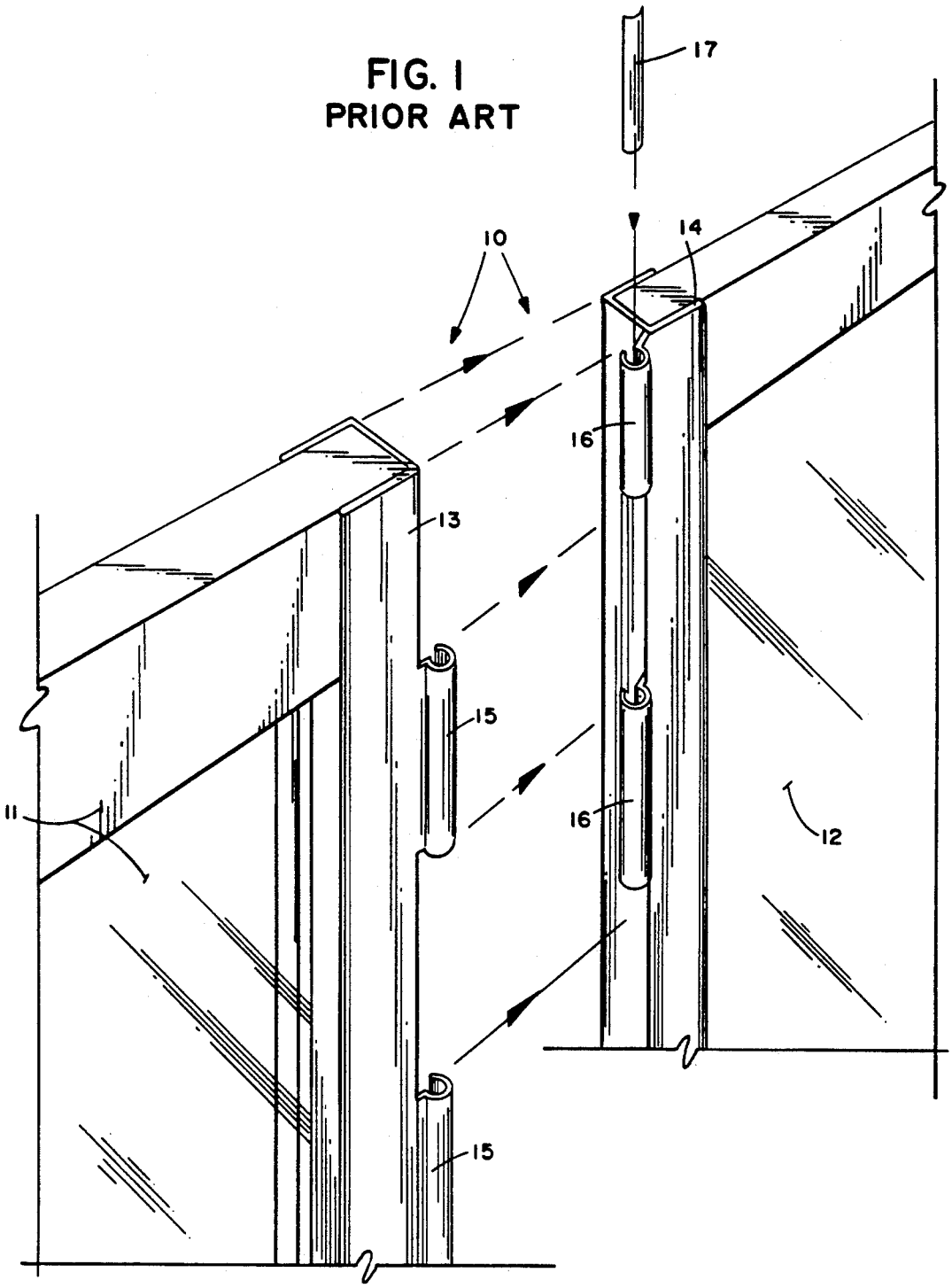
FIG. 1 PRIOR ART
FIG. 1 is a perspective view of a conventional prior art commercial construction for connecting panels together using staggered, semicircular extrusion elements and a hinge pin.

An exemplary panel assembly according to the prior art is shown generally by reference numeral 10 in FIG. 1. First and second panels 11, 12 (e.g. boat windshield components) are connected together utilizing aluminum extrusions 13, 14, which have staggered, cooperating, semicircular elements 15, 16, respectively, for receipt of a hinge pin 17. While such a structure effectively performs the function of pivoting the panels 11, 12 for movement with respect to each other about 180°, the assembly time and difficulties are significant, and a third component—the pin 17—is required.

Figure 2:
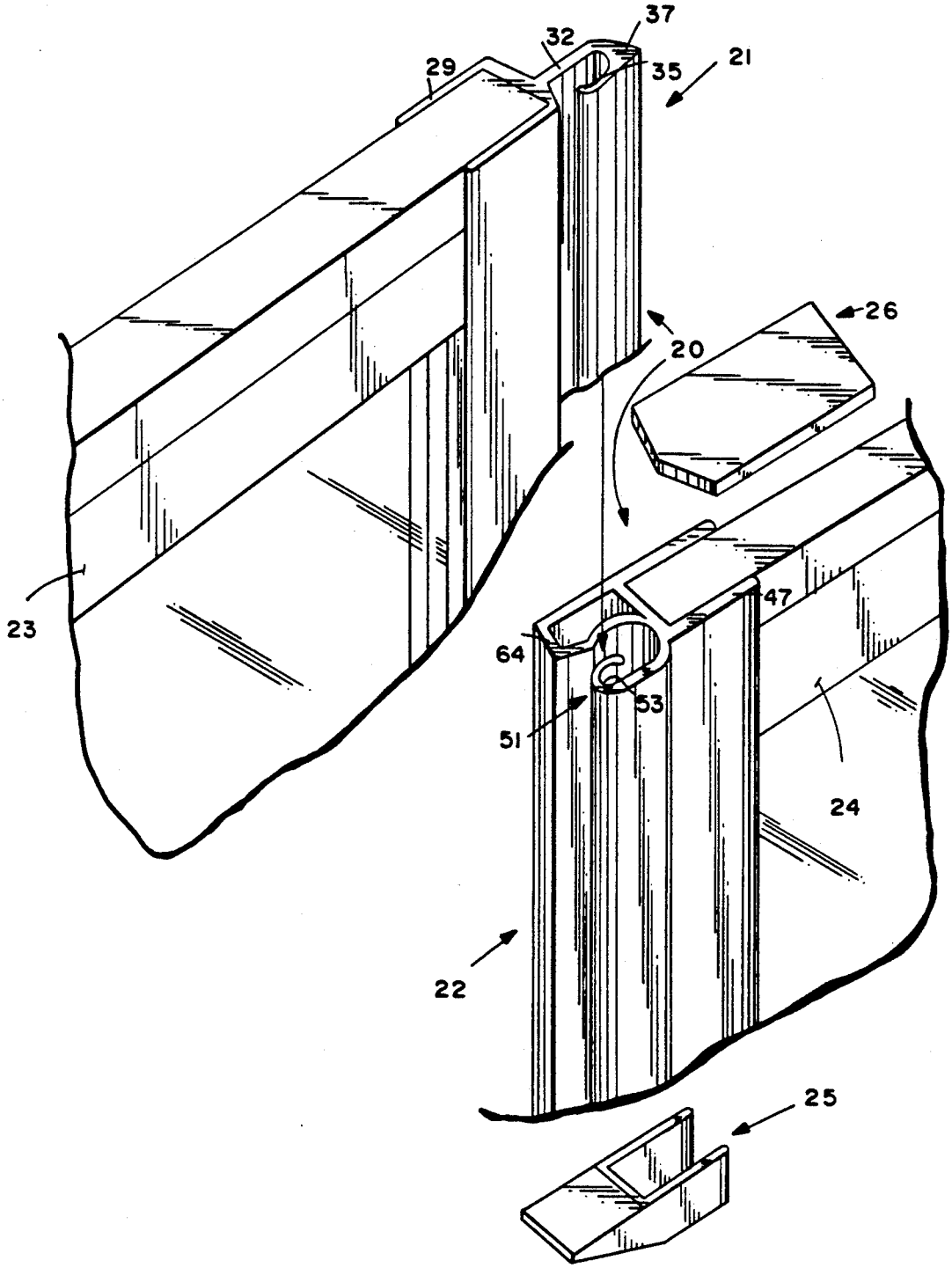
FIG. 2 is a view like that of FIG. 1 only showing panel assemblies with components according to the invention.

An exemplary assembly of panels according to the present invention is shown generally by reference numeral 20 in FIG. 2. The construction 20 includes a first elongated hinged component 21 and a second elongated hinge component 22, the components 21, 22 cooperating with panels 23, 24. Preferably both components 21, 22 are aluminum extrusions. These aluminum extrusions 21, 22 are shown in more detail in FIGS. 3 and 4. In the assembly of the structure 20, the first component 21 is merely slid downwardly with respect to the second component 22—as illustrated by the downward arrow in FIG. 2. A stop 25, of any suitable construction, is provided at the bottom of the extrusion 22 to limit the downward movement of the component 21 with respect to the component 22, and after the components 21, 22 (which typically have the same length, or the component 21 may be slightly shorter), a cap 26 may be provided on top of the extrusion 22 to prevent upward movement of the component 21. The cap 26 may be of any desired construction and can be connected to the extrusion 22 by adhesive, welding, or by elastic engagement (if the element 26 is of elastomeric or resilient material).

Figure 3:
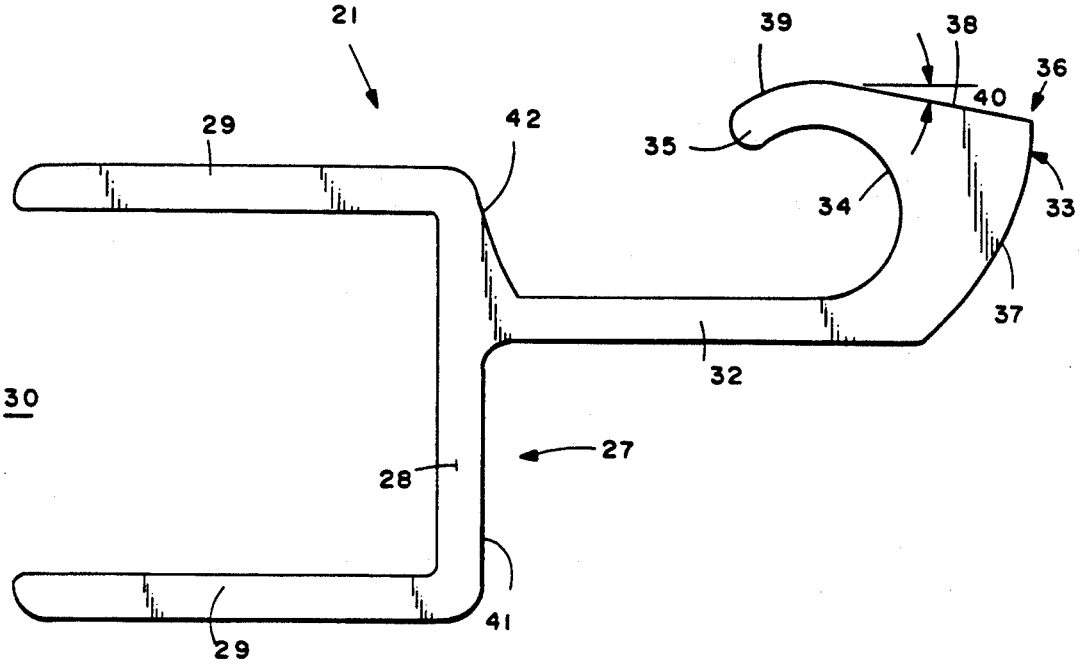
Figure 4:
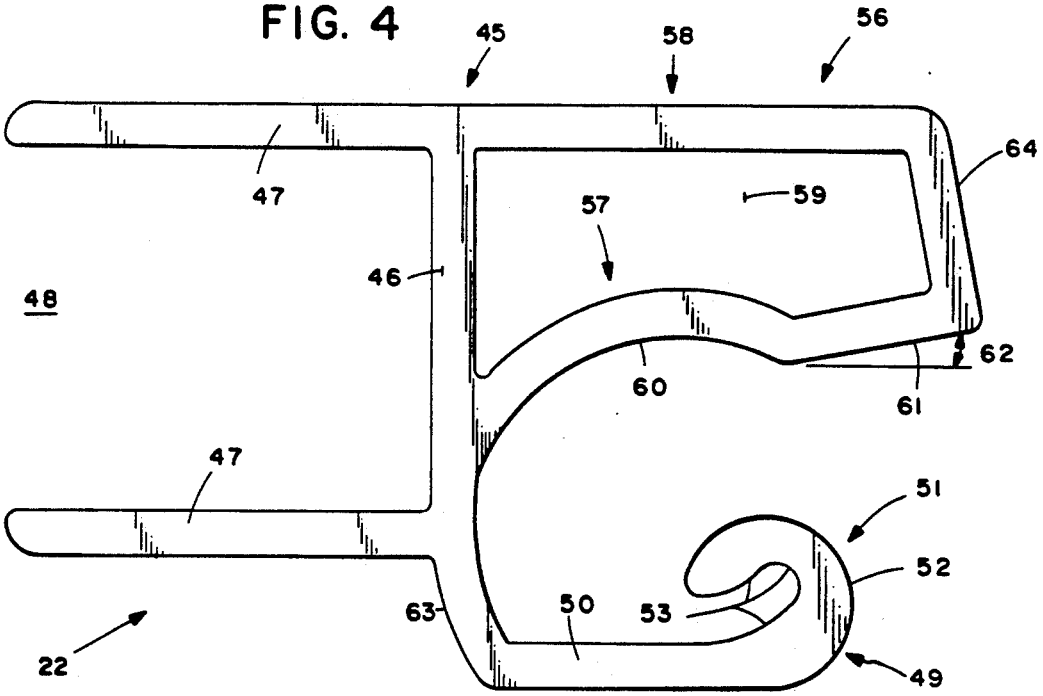
FIG. 4 is an end view of the second component of the structure of FIG. 2.

Extrusion 21 illustrated in FIG. 3 includes a body 27 having a main body portion 28, with spaced side walls 29 extending outwardly from one end of the main body 28. The side walls 29 define a channel 30. While a channel is illustrated in the exemplary embodiments in the drawing, other mechanisms for attachment of the main body 28 to a panel (e.g. panel 23) may be provided, such as a plate, clamp, U, or the like.

Extending outwardly from the main body element 28 opposite the channel side walls 29 is a generally straight first flange 32, which terminates in a first distal end 33. A hooked termination is provided for the first distal end 33 including an interior arcuate surface 34 having a first arc extending at least about 90° and less than about 270° (e.g. greater than 140° and typically about 180°-190°), with an exterior projecting surface 36 opposite the interior arcuate surface 34. The interior and exterior surfaces 34, 36 terminate in a common distal termination 35. Preferably, the exterior projecting surface 36 is formed of a portion 37 having an arc and intersect in a flattened portion 38 having an angle 40 with respect to a tangent to the curved surface 39 adjacent the common distal termination 35. The angle 40 typically is about 10°. The main body component 28 has a flat stop surface 41 on one side of the generally straight flange 32, and a radiused connection 42 to the flange 32 at the opposite side of the flange 32 from surface 41.

The second component 22 includes a second body 45 having a main body component 46 with channel defining side walls 47—defining a channel 48. Again, instead of channel defining side walls 47, any suitable equivalent structure may be provided. The second component 22 also comprises a second flange 49—having a generally straight portion 50 adapted to cooperate with the flange 32—which extends outwardly from the body component 46 and terminates in a second distal end 51. The second flange 49 also includes an exterior arcuate surface 52 having a second arc extending at least about 90° and less than about 270° (typically generally about 180°-190°—or the same amount as the surface 34). The arc of the surface 52 is equal to or slightly less than the first arc 34, cooperating therewith. Also, the second flange 49 includes a curved interior opening 53 of approximately the same size and shape as the common distal termination 35 of the first component 21.

The second component 22 may also include a third flange 56 extending outwardly from the body portion 46, and having side walls 57, 58 defining a hollow interior 59. The side wall 57 is spaced from the second flange 49 throughout the majority of the length thereof a distance approximately equal to the maximum dimension of the first flange exterior projecting surface 36 from the first flange interior arcuate surface 34. Preferably the third flange side wall 57 has an arcuate portion 60 with an arc approximately the same as the arc of the surface 37, of the majority of the length thereof, and has a flat distal surface 61 adjacent the arcuate portion 60. The flat distal portion 61 makes an angle 62 (typically about 10°) with respect to a tangent to the end termination of the arcuate portion 60, the surface 61 forming a stop surface. Another stop surface is formed by the radiused surface 63 connecting the second flange straight portion 50 to the main body element 46.

Figure 5:
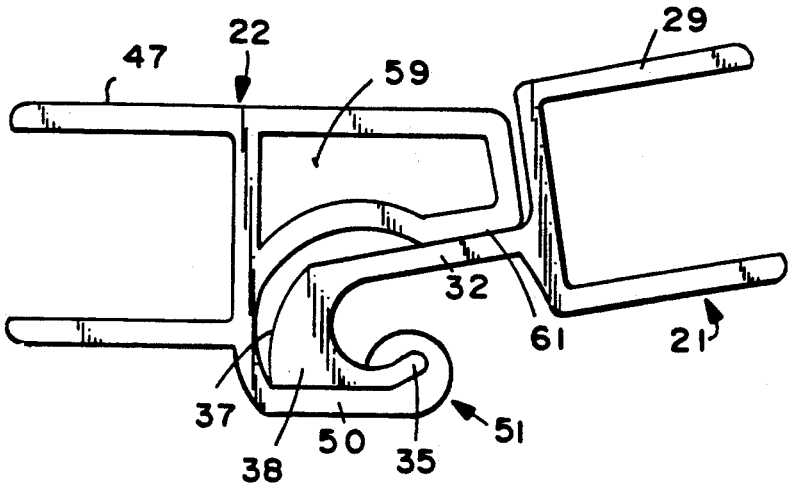
Figure 6:
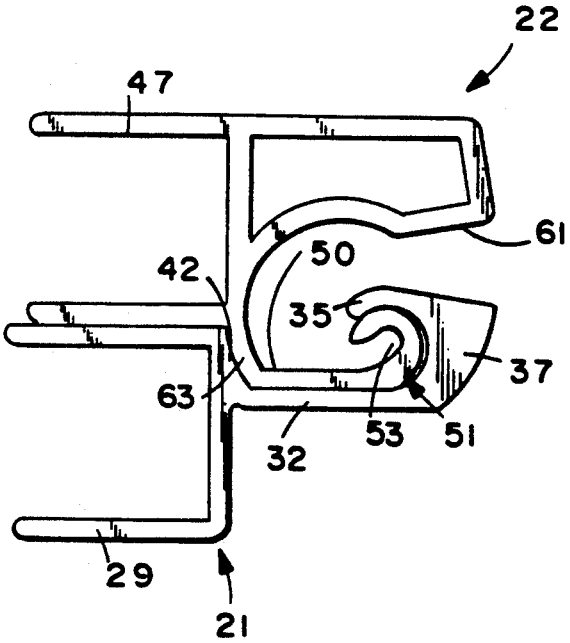
FIG. 6 is a view like that of FIG. 5 only showing the components of the other limit of travel.

The extremes of pivotal movement of the components 21, 22 are seen in FIGS. 5 and 6. In FIG. 5, the components—and the panels connected thereto—are generally in line with each other, the angle the panels make with each other being dependent upon the angle of the stop surface 61, which can be constructed to provide any relative positioning desired. In the actual embodiment illustrated in FIG. 5, the panels received by the channel side walls 29, 47 make an angle of about 10° with respect to each other (the angle of the surface 61). In this orientation, the stop surface 61 engages the generally straight first flange 32 and the common distal termination 35 is received within the opening 53, stop action being provided thereat too, as well as cooperation between the surface 38 and the straight portion 50 of the second flange 49. Note that the angles 62, 40 are the same, whatever they are chosen to be. Thus, positive stopping action is provided between the components while they still may relatively easily pivot with respect to each other.

FIG. 6 illustrates the orientation of the components 21, 22 where they are in the opposite extreme of pivotal movement from that illustrated in FIG. 5. In this orientation, the surface 34 is outside the surface 52, completely engaging and enveloping it, and a stop action is provided by engagement between the portions 32, 50, and the surfaces 42, 63. Note in actual use, the panels to which the channel side walls 29, 47 are connected may be wider than the side walls 47, 29 themselves, in which case positive stopping action may be provided by the panels themselves rather than the surfaces 42, 63, etc.; however, for those situations where the panels are narrower than the side walls 29, 47 the stop action is provided as illustrated in FIG. 6.

Note that there is simple and secure relative pivotal movement of greater than 140° between the two components 21, 22, yet they will not detach, and they are easily assembled together. Thus, the invention provides an extremely advantageous alternative to the commercial prior art such as illustrated in FIG. 1.

FIGS. 7A–7G show a second exemplary embodiment of hinge according to the invention. In this embodiment structures comparable to those in the FIGS. 2–6 embodiment are illustrated by the same reference numeral only preceded by a "1".

In the FIG. 7 embodiment, the channels 129, 147 of the two extrusions (components) 121, 122 respectively may mount bi-fold shower door panels (now shown) or the like. The second component 122 has a stop projection 161 which engages a recess 70 in component 121 to stop the components in a first, in-line, position (FIG. 7A). The component 122 also has a front face 71 adjacent the projection 161, and parallel to a comparable face 141 of the component 121.

As seen in FIGS. 7A–G, the first component 121 is movable through an arc of greater than 140° from the first stop position (FIG. 7A) to a second stop position (FIG. 7G), without the components 121, 122 detaching; i.e. in controlled operative engagement with each other (not "sloppy"). In the drawing the component 121 moves through an arc of about 190° (i.e. about 180°–190°) with respect to component 122.

The key to the capability of the two component hinge according to the invention being able to move through an arc of greater than 140° is the provision of different (multiple) axes of rotation along its path. For the exemplary embodiment illustrated, from the position shown in FIG. 7A through about the position illustrated in FIG. 7C, the components 121, 122 rotate about a first stationary axis defined by the extension 135 and slot 153; this first part of the arc, about a first center, is about 35–45% of the total arc (e.g. about 75° for the exemplary embodiment actually illustrated).

Figure 7A:
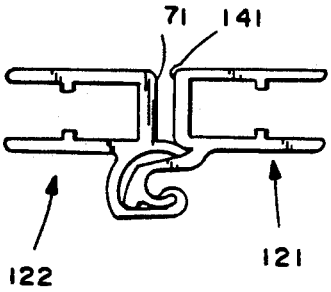
FIGS. 7A-7G are schematic end views that show the relative rotational positions of a second embodiment of hinge components at seven different locations along their arc of travel.
Figure 7B:
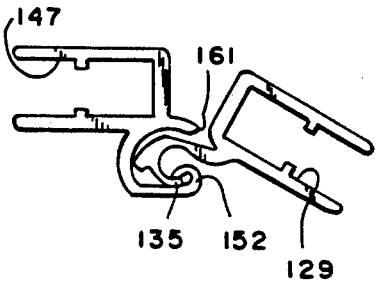
Figure 7C:
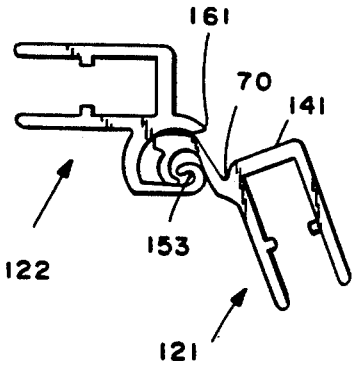
Figure 7D:
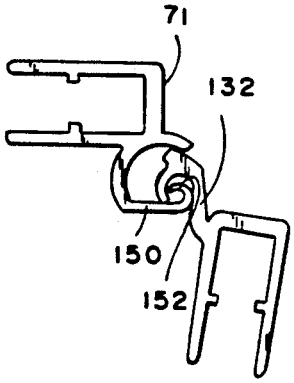

At about the position shown in FIG. 7D, the components 121, 122 no longer rotate about the first center (axis of rotation) but rather about a sliding center (i.e. about a moving axis of rotation) for a small part of the movement. This second part of the arc is about 10–20% of the total arc (e.g. about 30° for the exemplary embodiment illustrated).

Figure 7E:
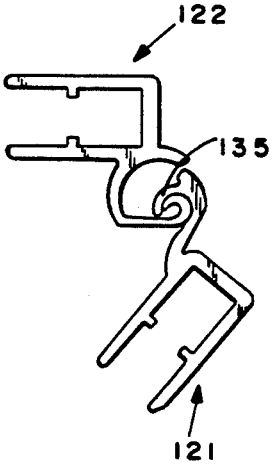
Figure 7F:
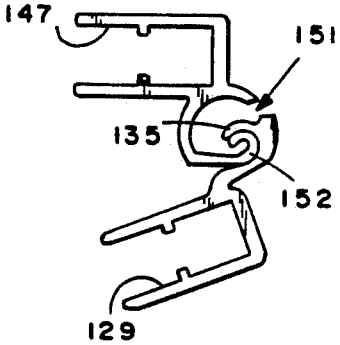
Figure 7G:
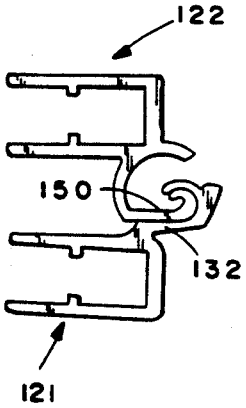

For the third and final part of the total arc of movement of component 121 with respect to component 122, the components 121, 122 rotate about a third, stationary, axis of rotation defined by arcuate outside surface 152 (FIGS. 7E–7G). This third part is roughly 40–50% of the total arc (e.g. about 85° for the exemplary embodiment illustrated). In the second stop position (FIG. 7G), the surfaces 132, 150 abut.

While the invention has been herein shown and described in what is presently conceived to be the most practical preferred embodiment thereof, it will be apparent to those of ordinary skill in the art that many modifications may be made thereof within the scope of the invention, which scope is to be accorded the broadest interpretation of the appended claims so as to encompass all equivalent structures and devices.

What is claimed is:

1. A hinge comprising first and second elongated cooperating components:

said first component comprising a first body, a generally straight first flange extending outwardly therefrom and terminating in a first distal end; a hooked termination of said first distal end, including an interior arcuate surface having a first radius extending between about 90 degrees and about 270 degrees, and an exterior projecting surface, said interior and exterior surfaces terminating in a common distal termination edge; and said second component comprising a second body, having: a second flange having a length, and extending outwardly therefrom and terminating in a second distal end, including an exterior arcuate surface having a second radius extending between about 90 degrees and about 270 degrees, and equal to or slightly less than said first radius and an interior opening of approximately the same size and shape as said common distal termination of said first distal end; and a third flange having a length and extending outwardly from said second body and having a side wall spaced a distance from said second flange throughout the majority of the length thereof approximately equal to the maximum dimension of said first flange exterior projecting surface from said first flange interior arcuate surface; and one of said components moving through an arc of about minus 10 degrees to about 180 degrees with respect to the other component from a first position to a second position, without detachment from said other component.

2. A hinge as recited in claim 1 wherein said elongated first and second bodies comprise channel shaped elements having a base and a pair of side walls extending upwardly from said base, said flanges extending outwardly from said bases.

3. A hinge as recited in claim 2 in combination with a panel received within each of said channel shaped body elements.

4. A hinge as recited in claim 1 wherein said first and second components are each formed by an integral aluminum extrusion.

5. A hinge as recited in claim 1 further comprising a flat distal surface of said third flange side wall forming a stop for relative movement of said first flange with respect to said second flange.

6. A hinge as recited in claim 1 wherein said third flange side wall has an arcuate portion with a radius; and wherein said exterior projecting surface of said first flange includes at least a portion thereof having a radius approximately equal to the radius of said third flange arcuate portion.

7. A hinge as recited in claim 6 further comprising a flat distal surface of said third flange side wall, adjacent said arcuate portion of said side wall, and forming a stop for relative movement of said first flange with respect to said second flange.

8. A hinge as recited in claim 1 wherein said second component second flange has a straight surface generally coextensive with said generally straight first flange to provide a stop between the first and second components when said distal termination of said first component is not received by said interior opening of said second flange.

9. A two piece hinge consisting of first and second elongated cooperating components;

surface means extending from said components for cooperating with each other so that said components are movable in controlled operative engagement with each other from a first position to a second position, one of said components moving through an arc of greater than about 180 degrees from said first position to said second position, without detachment; said surface means comprising means for cooperating so that said components are movable in controlled operative engagement with each other from said first to said second position, and so that said surface means define multiple different axes of rotation during relative movement of said components through said arc from said first position to said second position:

wherein said components are elongated in a dimension of elongation and have open ends at opposite ends in said dimension of elongation so that they are movable into operative association with each other only by relative sliding movement therebetween along the dimension of elongation thereof.

10. Pivotally connected first and second panel assemblies, said first panel assembly comprising a panel and a first elongated component, sand said second panel assembly comprising a panel and a second elongated component;

said first and second elongated components cooperating to form a hinge allowing relative pivotal movement between about 90 degrees and about 270 degrees of said first panel assembly with respect to said second panel assembly, without detachment;

said first component comprising a first body, a generally straight first flange extending outwardly therefrom and terminating in a first distal end; a hooked termination of said first distal end, including an interior arcuate surface having a first radius extending between about 90 degrees and about 270 degrees, and an exterior projecting surface, said interior and exterior surfaces terminating in a common distal termination edge; and said second component comprising a second body, having: a second flange having a length, and extending outwardly therefrom and terminating in a second distal end, including an exterior arcuate surface having a second radius extending between about 90 degrees and about 270 degrees, and equal to or slightly less than said first radius and an interior opening of approximately the same size and shape as said common distal termination of said first distal end; and a third flange having a length and extending outwardly from said second body and having a side wall spaced a distance from said second flange throughout the majority of the length thereof approximately equal to the maximum dimension of said first flange exterior projecting surface from said first flange interior arcuate surface.

11. Pivotally connected panel assemblies as recited in claim 10 wherein each of said panels is primarily of transparent material, comprising components of a boat windshield, and wherein said first and second components are each formed by an integral aluminum extrusion.

12. Pivotally connected panel assemblies as recited in claim 11 wherein said third flange side wall has an arcuate portion with a radius; and wherein said exterior projecting surface of said first flange includes at least a portion thereof having a radius approximately equal to the radius of said third flange arcuate portion.

13. Pivotally connected panel assemblies as recited in claim 12 further comprising a flat distal surface of said third flange side wall, adjacent said arcuate portion of said side wall, and forming a stop for relative movement of said first flange with respect to said second flange; and wherein said second component second flange has a straight surface generally coextensive with said generally straight first flange to provide a stop position between the components when said distal termination of said first component is not received by said interior opening of said second flange.

14. An elongated aluminum extrusion comprising: a generally straight first flange extending outwardly from a first body, and terminating in a first distal end; a hooked termination of said first distal end, including an interior arcuate surface having a first radius extending about 180 degree, and an exterior projecting surface opposite said interior arcuate surface, said interior and exterior surfaces terminating in a common distal edge termination, connected together by a flat portion; said exterior projecting surface of said first flange including a portion thereof having a radius different than said first radius.

15. An elongated aluminum extrusion comprising a body having a flange extending outwardly therefrom and terminating in a distal end, including an arcuate surface having a radius of about 180°; means defining an interior curved opening in said distal end; a second flange extending outwardly from said body and having a side wall spaced from said first flange throughout the majority of the length thereof, said second flange side wall having an arcuate portion with a radius, and a flat distal surface adjacent said arcuate portion, and said second flange being hollow.

16. A two piece hinge consisting of first and second elongated cooperating components;

surface means extending from said components for cooperating with each other so that said components are movable in controlled operative engagement with each other from a first position to a second position, one of said components moving through an arc of greater than about 180 degrees from said first position to said second position, without detachment; said surface means comprising means for cooperating so that said components are movable in controlled operative engagement with each other from said first to said second position, and so that said surface means define multiple different axes of rotation during relative movement of said components through said arc from said first position to said second position;

wherein said surface means: define a first, stationary, axis of rotation during relative movement of said components through a first part of said arc; define a sliding axis of rotation through a second part of said arc; and define a third, stationary, axis of relation during relative movement of said components through a third part of said arc; and wherein said first part of said arc is roughly 35–45% of said arc, said second part is roughly 10–20% of said arc, and said third part is roughly 40–50% of said arc.

* * * * *